US005277544A

United States Patent [19]

Naudet

[11] Patent Number: 5,277,544

[45] Date of Patent: Jan. 11, 1994

[54] BLADE CONTROL ROD AND SYSTEM OF SUCH RODS

[75] Inventor: Jacky Naudet, Bondoufle, France

[73] Assignee: Societe Nationale d'Etude et de Construction de Moteurs d'Aviation "S.N.E.C.M.A.", Paris, France

[21] Appl. No.: 947,541

[22] Filed: Sep. 21, 1992

[30] Foreign Application Priority Data

Oct. 2, 1991 [FR] France ..... 91 12102

[51] Int. Cl.[5] ..... F01D 17/16

[52] U.S. Cl. ..... 415/160

[58] Field of Search ..... 415/148, 150, 159, 160, 415/161, 162, 163, 164

[56] References Cited

U.S. PATENT DOCUMENTS 4,231,703 11/1980 Weiler ..... 415/159
4,732,536 3/1988 Lejars et al. ..... 415/160
5,039,277 8/1991 Naudet ..... 415/160

FOREIGN PATENT DOCUMENTS 2835349 4/1979 Fed. Rep. of Germany .
2583817 12/1986 France .

*Primary Examiner*—Edward K. Look
*Assistant Examiner*—Christopher M. Verdier
*Attorney, Agent, or Firm*—Oblon, Spivak, McClelland, Maier & Neustadt

[57] ABSTRACT

A blade control rod system for controlling blades of a gas turbine stator is provided with at least one rod for controlling an associated blade. The blade includes a shaft about which the blade pivots with one end of the rod being engaged on the blade. The control rod system includes a projection which extends beneath a portion of at least one adjacent rod, so that the accidental loosening of a nut which secures the rod on the shaft of the blade is not sufficient to allow the rod to become detached.

5 Claims, 3 Drawing Sheets

BLADE CONTROL ROD AND SYSTEM OF SUCH RODS

BACKGROUND OF THE INVENTION

Field of the Invention

Discussion of the Related Art

The invention relates to a blade control rod, as well as to system of such rods.

Certain gas turbines have variable setting stator blade stages, i.e. which pivot about a shaft radially traversing the stator. It is therefore possible to inflect the flow of gases into the engine and maintain a satisfactory efficiency no matter what the rotor speed. Pivoting is brought about by a lever known as a rod, whereof one end is engaged on the shaft end, which projects outside the stator and whereof the other end is connected to a control mechanism such as a ring, whose displacement leads to the simultaneous tilting of all the rods. A conventional construction consists of giving the shaft end a square, rectangular or similar section and the corresponding end of the rod is given an eye or hole having the same shape, or a more elongated shape so that the rod can slide longitudinally. The other rod end carries a shaft, which pivots freely in the control ring.

It has already been found that rods were relatively fragile and the breaking thereof could not be excluded. The blade is then no longer directed and assumes a flag-like configuration in which there is no control of the blade. As modern engines are designed with small clearances, there is a considerable risk of the blade turning until its end is close to the rotor and whose profile is oblique touches the latter, which leads to serious damage. Even more serious damage can be caused by aerodynamic instability caused by irregular flows, because the free blades are then exposed to shear stresses, as are the parts assembling them with the stator. This can give rise to cracks, which can then lead to the breaking, e.g. at the root of the blade.

French patent 2 583 817 shows that consideration has already been given to the placing of rods close to one another and with straight lateral edges separated by a relatively small clearance, so that if one rod breaks, the pivoting of the associated blade is interrupted relatively rapidly by the contact of the end of the rod, which is integral with adjacent rods. The blade then forms an angle only slightly different from that of the others and scarcely affects the efficiency of the engine. The control of the ring is not disturbed, because the intact rods in contact with the end of the broken rod can turn it on pushing it back.

However, this system is not successful if there is a detachment of the fixing means holding the rod in place. This fixing means is generally a nut engaged on a threaded end of the shaft end and whose loosening cannot be excluded. The rod may then pass out of the blade shaft and any control of the blade would become impossible. The free rod might then damage the engine.

SUMMARY OF THE INVENTION

The invention is based on these considerations. Its essential object is to prevent the disengagement between the rod and the blade with which it is associated, even if the fixing means is lost by detachment.

The essential means for this is a projection on the rod and which extends below a portion of the adjacent rod in such a way that the projection is retained towards the blade. The direction by which a distinction is made between the position of the projection and that of the adjacent rod portion is not the vertical, but the direction according to which the rod is extracted from the end of the shaft on the associated blade, i.e. the direction of the said shaft or axis. In the normal case when the invention is applied to a system or plurality of rods of blades distributed in ring-like manner, the projections will be at internal positions and the portions of the adjacent rods at external positions.

The projection can also extend over a portion of the adjacent rod. It is then retained between the two indicated portions, but with a clearance sufficient to prevent any jamming. The rod can then have another projection extending over a portion of another adjacent rod.

The invention also relates to systems of control rods complying with these characteristics.

BRIEF DESCRIPTION OF THE DRAWINGS

The invention is described in greater detail hereinafter relative to non-limitative embodiments and with reference to the attached drawings, wherein show.

DESCRIPTION OF THE PREFERRED EMBODIMENTS

Figure 1:
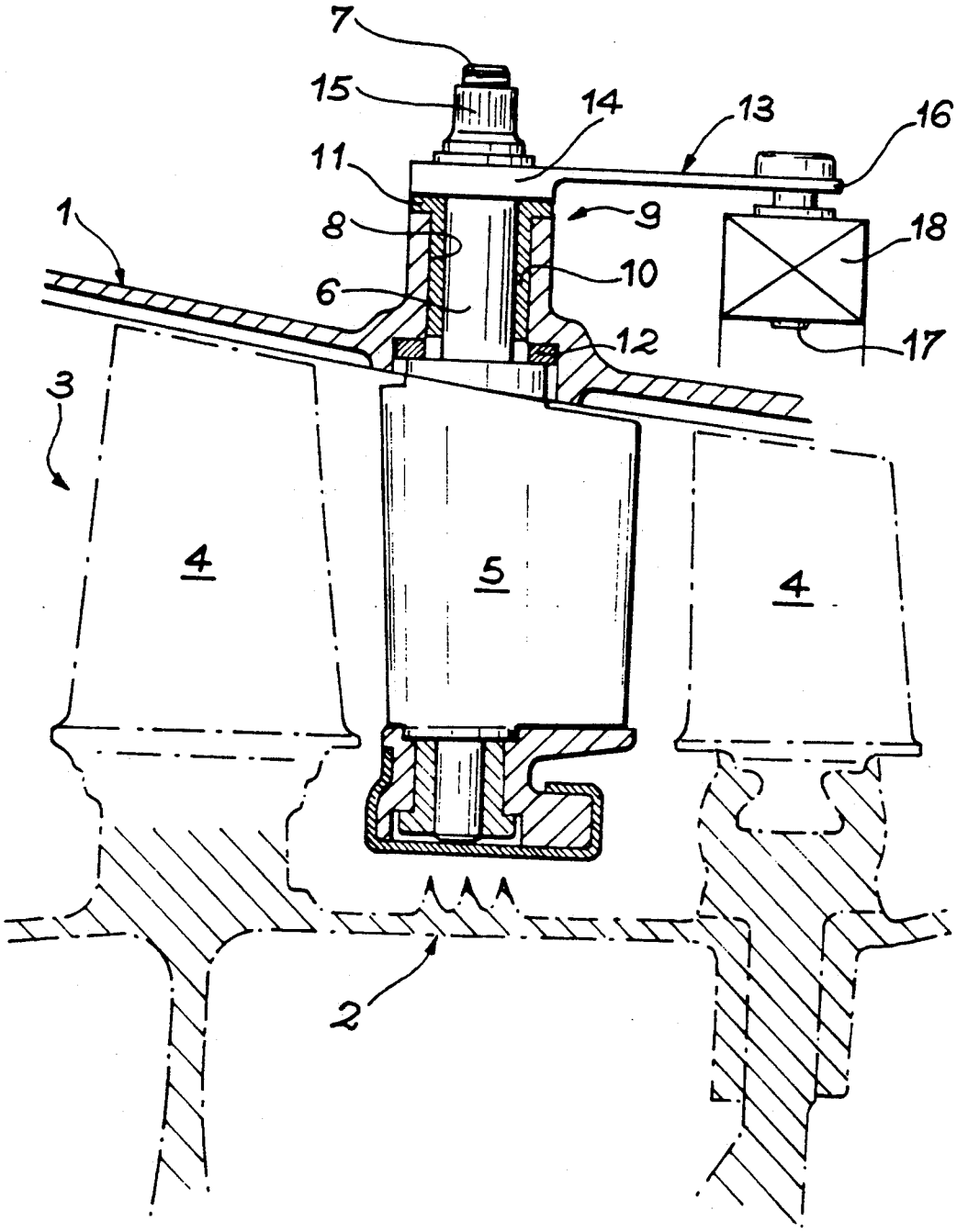
FIG. 1: A system of blades and rods in a plane passing through the axis of the gas turbine.

In FIG. 1, reference 1 designates a gas turbine stator in the form of a more or less conical envelope and whereof only part is shown. The stator 1 surrounds a rotor 2 and is separated therefrom by an annular portion 3 occupied by circumferential stages of mobile blades 4 belonging to the rotor 2. The stator 1 has other blade stages for correcting the flow of gases, which alternate with the mobile blade stages 4 and whereof some are constituted by variable setting blades 5. Such blades are provided with a shaft 6 oriented in radial manner and which traverses the stator 1 and projects to the outside, where it is terminated by a threaded shaft end 7. The shaft 6 pivots in a recess 8 of the stator 1 via a bearing 9, which is fixed to the shaft 6 and is constituted by a cylindrical portion 10 located in the recess 8 and which facilitates the pivoting of the shaft 6 and a planar portion 11 bearing on the outer end face of the recess 8 and which serves to retain the shaft 6 to prevent the blade 5 from dropping on the rotor 2. As the displacement of the blade 5 to the outside is prevented by an abutment on an inner washer 12 located on the inner end face of the recess 8, the blade 5 can only pivot about its shaft 6.

The rod 13 controlling these pivoting movements has an end 14 engaged around the shaft 6 until it abuts against the planar portion 11. The end 14 is retained towards the blade 5 and pressed against the portion 11 by a nut 15 screwed on the threaded shaft end 7 of an outer washer and interposed between the end 14 and the nut 15. The other end 16 of the rod 13 is terminated by a smooth, radial shaft 17 and is engaged in a recess of a control ring 18. Thus, if the nut 15 goes missing, the rod 13 can escape freely to the outside.

Figure 2:
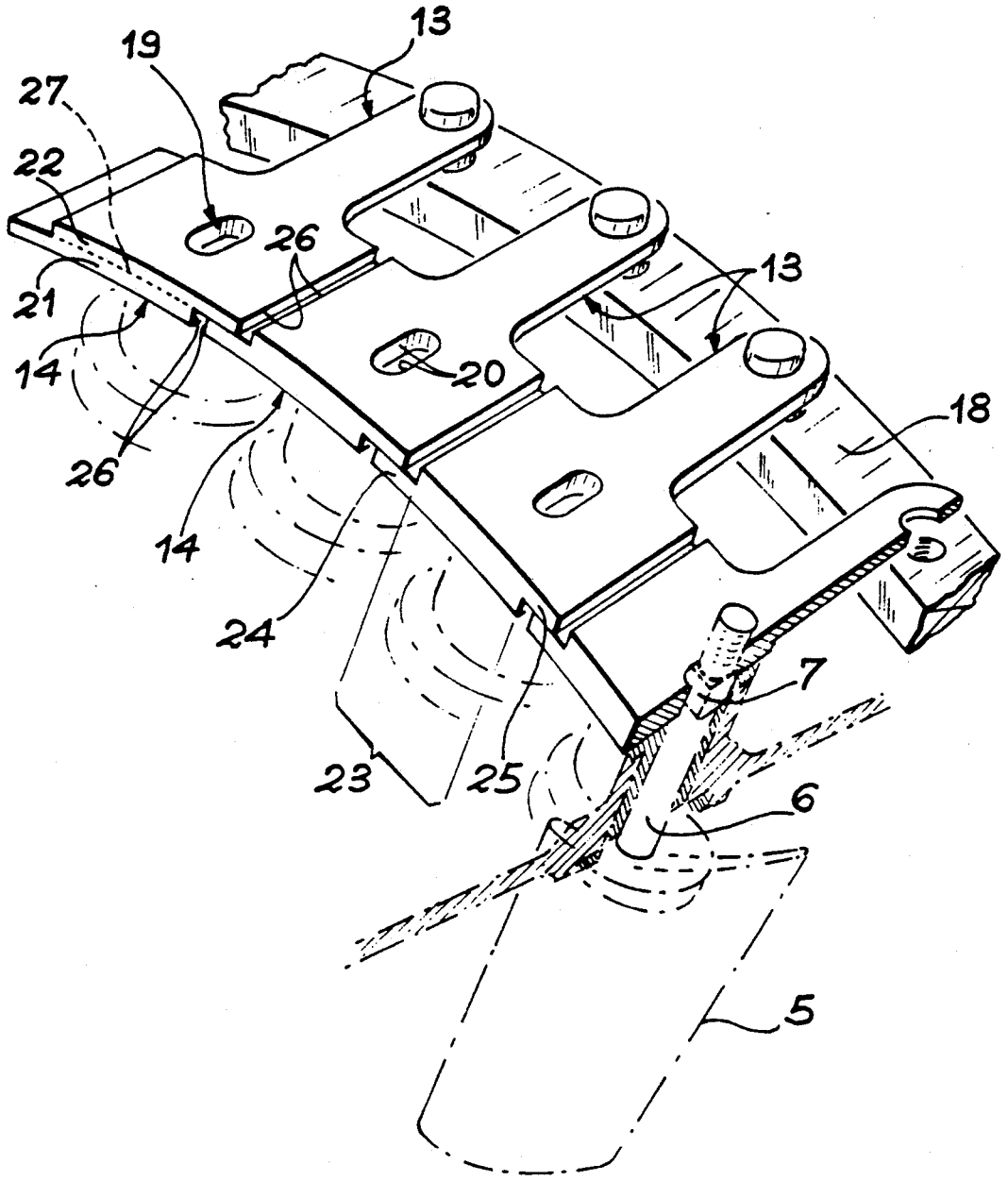
FIG. 2: A view of the system of rods according to the invention.

FIG. 2 illustrates a system of rods 13 in perspective and illustrates their special features. The center of each end 14 has an oblong eye or hole 19 with straight lateral edges 20 oriented in accordance with the length of the rod 13. The rods 13 can slide longitudinally about shaft ends 7 as a function of the displacements of the control ring 18. The shaft ends 7 are provided with flats, which slide on straight lateral edges 20 and ensure the pivoting transmission to the blades 5.

The ends 14 are formed from two superimposed plates, namely a lower or inner plate 21 and an upper or outer plate 22. The plates 21 and 22 have a superimposed area 23, the lower plates 21 having a leftward projecting portion 24 and the upper plates 22 a rightward projecting portion 25. Straight lateral edges 26, by which an end 14 of a broken rod 13 touches its neighbors as soon as the blade 5 with which it is associated tends to assume a flag-like configuration, are provided in the same way as in the aforementioned patent and are distributed over the plates 21 and 22. Moreover, the projecting portions 24 of the lower plates 21 in each case pass under the projecting portion of an upper plate 25, i.e. the rods 13 are mutually imbricated or overlapped in this arrangement, where they are all alike on the circumference of the gas turbine. It is clear that if a nut 15 is detached, the rod 13 in question can move slightly towards the outside, but is locked as soon as the projecting portion 24 of its lower plate 21 touches the projecting portion 25 of the upper plate 22 of the rod 13 positioned to its left. The plates 21 and 22 can be in one piece or can be assembled by welding along line 27.

Figure 3:
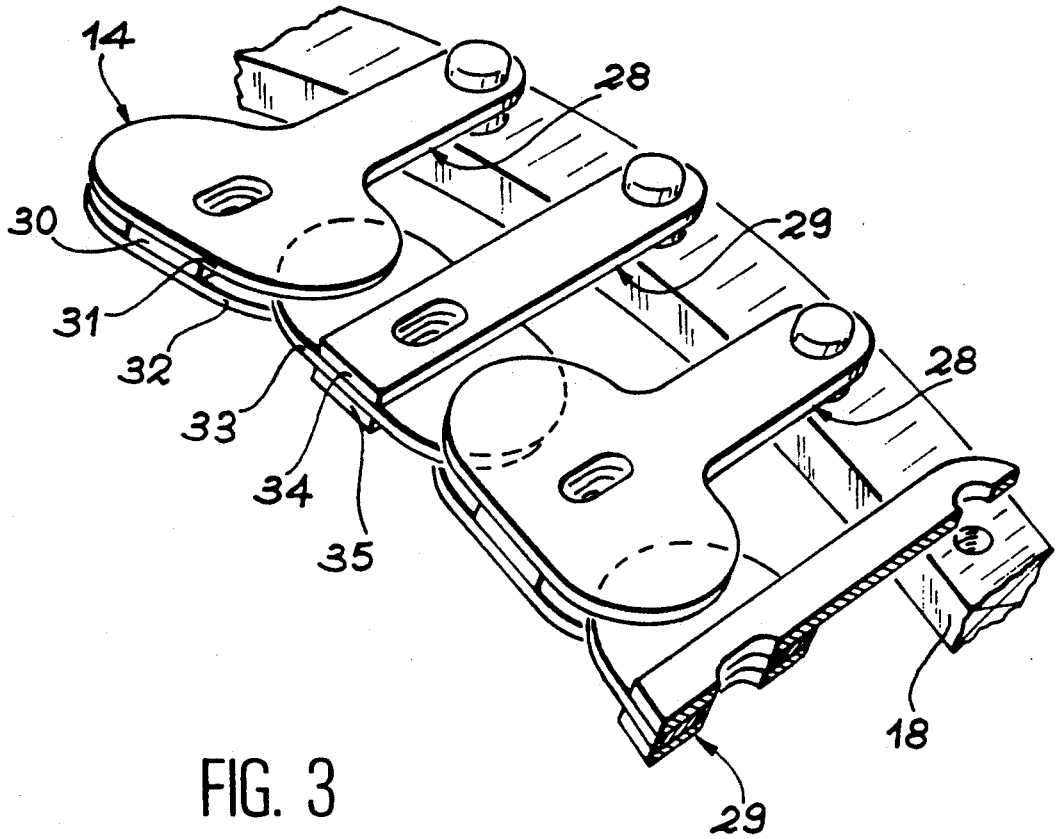
FIGS. 3 and 4: Views of another system of rods also according to the invention.
Figure 4:
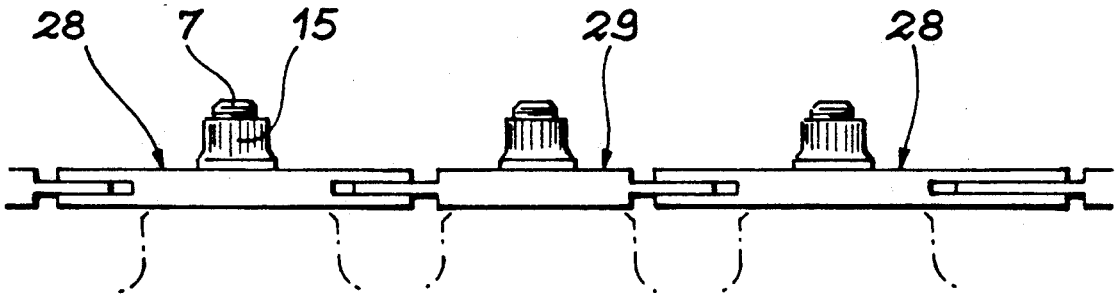

It is also possible to see another system of rods 28 and 29 in FIGS. 3 and 4. In this case there are two different types, but their ends 14 are all formed from three superimposed plates. The rods 28 have ends 14 formed by a narrow median plate 30 between two upper and lower, wide plates 31, 32, which therefore project over and under the narrow median plate 30 on two sides and form two reception cavities, whereas the ends 14 of the rods 29 are constituted by a median wide plate 33 positioned between two upper and lower, narrow plates 34, 35. The wide median plate 33 extends, projecting over the two sides on the upper and lower, narrow plates 34, 35, between portions of the upper and lower plates 31 and 32 of each of the two adjacent rods 28. It is once again possible here to produce the rods 28 or 29 from a single block by cutting them in the mass or by welding the initially separate plates 30 to 32 and 33 to 35. It is advantageous in the latter case for the rod 28 or 29 to be in one piece with one of the plates, such as the upper plate 31 or 34. It again constitutes an overlapping arrangement preventing the separate extraction of the rods 28 and 29.

If it is necessary to replace one rod 13, 28 or 29, it is necessary to disassemble several at once and remove them slightly from the shaft end 7 until the cumulative clearances make it possible to sufficiently move the adjacent rods away from that which is to be replaced so as to permit the complete removal thereof.

I claim:

1. A blade control rod system for controlling blades of a gas turbine stator, comprising:

at least one rod for controlling an associated blade, the blade comprising a shaft about which the blade pivots, one end of said at least one rod being engaged on the blade, the other end of said at least one rod being fitted to a control mechanism, said at least one rod being maintained on the shaft by a fixing means; and a projection extending in a direction of the shaft beneath a portion of an adjacent rod for retaining the projection towards the blade.

2. The blade control rod system according to claim 1, wherein the projection also extends over a further portion of said adjacent rod.

3. The blade control rod system according to claim 1, wherein the rod has a further projection extending over a portion of a further adjacent rod.

4. The blade control rod system according to claim 3, wherein the rods are identical and in each case formed by two plates assembled in such a way that they have superimposed portions and nonsuperimposed portions, which constitute the projections.

5. The blade control rod system according to claim 3, wherein the rods are alternately formed with two opposite projections and two pairs of portions having a reception cavity for one of the projections.

* * * * *